US006571762B2

(12) United States Patent
Rieger

(10) Patent No.: US 6,571,762 B2
(45) Date of Patent: Jun. 3, 2003

(54) CYLINDER HEAD OF AN INTERNAL COMBUSTION ENGINE

(75) Inventor: Ulrich Rieger, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/176,937

(22) Filed: Jun. 21, 2002

(65) Prior Publication Data

US 2002/0195077 A1 Dec. 26, 2002

(30) Foreign Application Priority Data

Jun. 23, 2001 (DE) ..... 101 30 408

(51) Int. Cl.[7] ..... F02F 1/42
(52) U.S. Cl. ..... 123/193.5
(58) Field of Search ..... 123/193.5, 193.3, 123/193.1; 60/272; 29/888.061

(56) References Cited

U.S. PATENT DOCUMENTS 4,031,699 A * 6/1977 Suga et al. ..... 123/193.5
4,089,163 A * 5/1978 Yamazaki et al. ..... 123/193.5
4,207,660 A * 6/1980 Rao et al. ..... 123/193.5
4,430,856 A * 2/1984 Niedert ..... 123/193.5
4,604,779 A * 8/1986 Narita et al. ..... 123/193.5
5,150,572 A * 9/1992 Johnson et al. ..... 123/193.5
6,390,051 B2 * 5/2002 Hilpert et al. ..... 123/193.5

FOREIGN PATENT DOCUMENTS

DE 39 15 988 12/1989

* cited by examiner

*Primary Examiner*—Marguerite McMahon
(74) *Attorney, Agent, or Firm*—Kenyon & Kenyon

(57) ABSTRACT

A cylinder head of an internal combustion engine includes at least one exhaust port, which is formed by a port liner of at least two layers cast into the cylinder head, provided with a heat-insulating layer and having a sheet metal port, the sheet metal port being surrounded by a helically wound sheet metal strip.

8 Claims, 1 Drawing Sheet

CYLINDER HEAD OF AN INTERNAL COMBUSTION ENGINE

FIELD OF THE INVENTION

The invention relates to a cylinder head of an internal combustion engine.

BACKGROUND INFORMATION

German Published Patent Application No. 39 15 988 describes a cylinder head of an internal combustion engine, which has at least one exhaust port, which is formed by a sheet metal port cast into the cylinder head. The sheet metal port is composed of at least two layers of sheet metal, which form a gap, which constitutes a heat-insulating layer. A port cast or inserted into the cylinder head of an internal combustion engine in order to thermally insulate the hot exhaust gas from the cylinder head material and the coolant is known as a port liner.

SUMMARY

An object of the present invention is to provide a multilayer sheet metal port liner for an exhaust port in the cylinder head of an internal combustion engine, which while affording improved heat insulation, is easy to manufacture.

In the cylinder head of an internal combustion engine according to the present invention with a cast-in port liner of at least two layers, provided with a heat-insulating layer and having a sheet metal port, the sheet metal port is helically wrapped by a sheet metal strip, a heat-insulating layer arranged both between the individual layers of the sheet metal strip and also between the sheet metal strip and the sheet metal port. Winding a sheet metal strip around a sheet metal port makes a multilayer port liner, provided with an insulating layer, for an exhaust port in a cylinder head of an internal combustion engine easy and inexpensive to manufacture.

In an example embodiment, the sheet metal port is cast in the cylinder head in the area of the valve guide. In order to prevent any distortion of the port liner as a result of the large temperature fluctuations in the operation of the internal combustion engine, the port liner is firmly cast in the cylinder head at only one point. This may be done in the area of the valve guide, since due to an approximately central fixing of the sheet metal port, the thermal expansion occurs in two directions. As a result, the absolute thermal expansion at each of the two port ends is less than if it were fixed at one end.

In another example embodiment of the present invention, the sheet metal port is supported by the wound sheet metal strip so that the port is longitudinally displaceable in the cylinder head, in order to prevent any deformation due to the stresses in the event of high thermal expansion. The sheet metal port is able to slide longitudinally in the wound sheet metal strip due to the single support for the sheet metal port in the area of the valve guide and because the sheet metal strip is cast into the cylinder head.

In a further example embodiment of the present invention, the sheet metal strip is provided with a coating. This makes the sheet metal strip easy to deform when winding and at the same time affords a heat-insulating effect.

The coating may be made of graphite. When casting, graphite does not release any gases, which might lead to the formation of shrinkage cavities in the cylinder head material. Graphite is furthermore a good thermal insulator.

The sheet metal port may be manufactured by internal high-pressure metal forming. By this method, it is possible to manufacture a sheet metal port of virtually any form and shape without a joint weld seam or similar flow restrictions.

In a further development of the present invention, the sheet metal port has an essentially greater wall thickness than the sheet metal strip. The wall thickness of the sheet metal port is approximately 1 to 1.5 mm, for example. The sheet metal port thereby has a low heat capacity, which may allow rapid heating up of the exhaust gas. It nevertheless may allow adequate strength at high exhaust gas temperature and exhaust gas pressures. The sheet metal strip is made, for example, from a steel foil a few tenths of a millimeter thick. Such a thin foil may be made to conform to a given shape of the sheet metal port by helically winding and where necessary pressing on. The sheet metal strip in conjunction with the coating affords good heat insulation for adequate strength and service life of the overall port liner.

One example method of manufacture is to wrap a tube with sheet metal strip, and then to form the wrapped tube into a sheet metal port by internal high-pressure metal forming. Since a straight tube is much easier to wrap than a pre-formed sheet metal port, such a method of manufacture is well suited to automated wrapping.

Further features and combinations of features are set out in the description and the drawings. Exemplary embodiments of the present invention are represented in simplified form in the drawings and explained in more detail in the following description.

DETAILED DESCRIPTION

Figure 1:
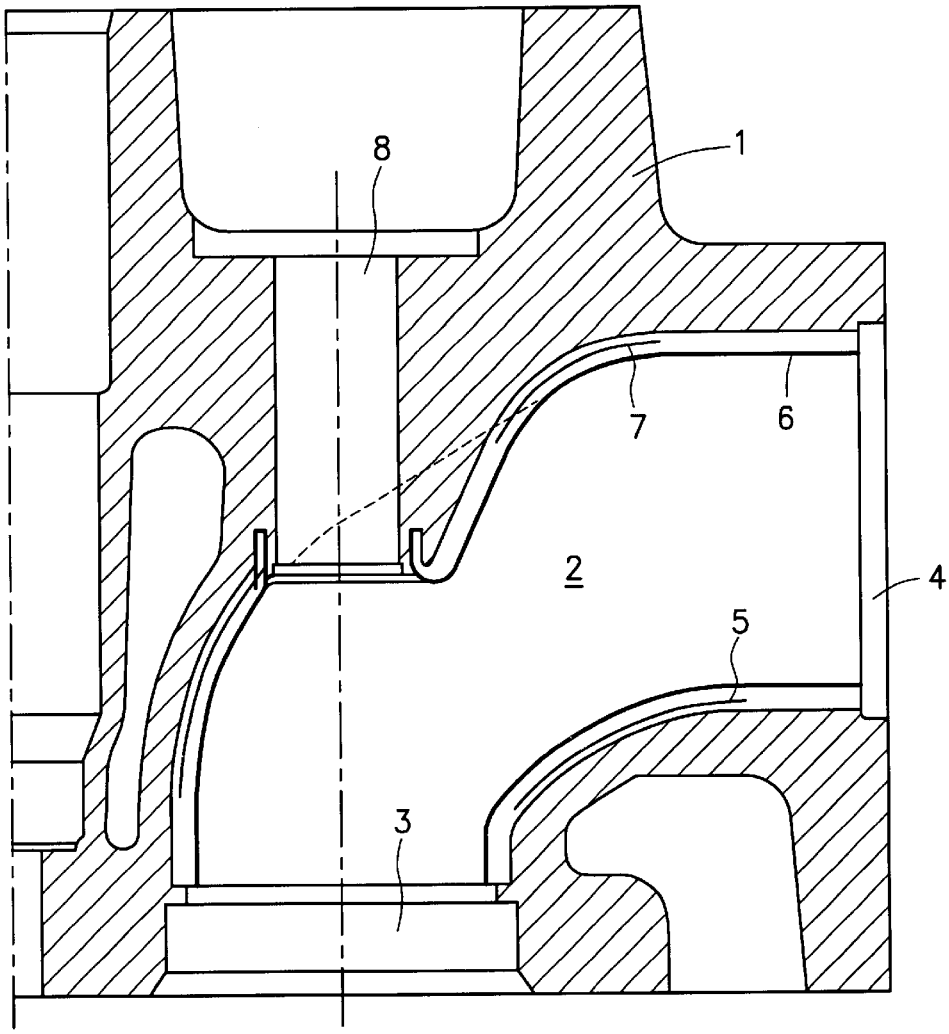
FIG. 1 is a cross-sectional view through a cylinder head having an exhaust port according to the present invention.
Figure 2:
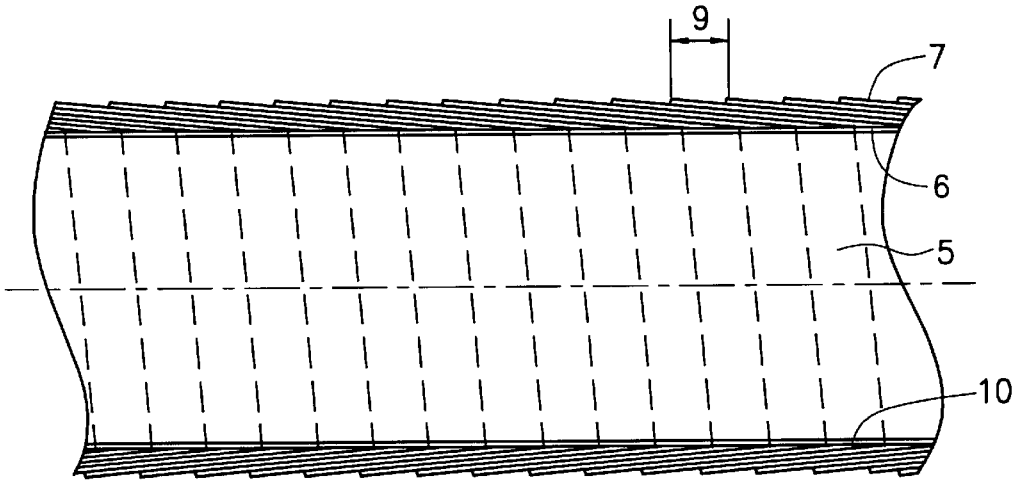
FIG. 2 illustrates a sheet metal port, which has been helically wrapped by a sheet metal strip.

FIG. 1 illustrates a cylinder head 1 of an internal combustion engine having an exhaust port 2, which leads from a seating ring area 3 to an exhaust flange 4. The exhaust port 2 includes a port liner 5 cast into the cylinder head 1, the liner in turn including a sheet metal port 6 and a sheet metal strip 7 wound helically around the sheet metal port, as illustrated in FIG. 2. In the area of the valve guide 8, the sheet metal port 6 is cast into the cylinder head 1 and thereby fixed in position. With an approximately central support for the sheet metal port, any variation in length due to differing thermal expansion of the cylinder head 1 and the sheet metal port 6 makes itself less noticeable. The displacement due to the thermal expansion occurs both at the end of the sheet metal port 6 in the seating ring area 3 and at the exhaust flange end. The sheet metal port 6 is wrapped by a sheet metal strip 7 so that except in the area of the valve guide 8, the port is not in direct contact with the casting material of the cylinder head 1. The sheet metal port 6 is firmly embedded in the cylinder head 1 by the wrapped sheet metal strip 7, which is in turn surrounded by cylinder head material, so that only minimal movements due to thermal expansion are still possible, thereby preventing a distortion in operation. Wrapping the sheet metal port 6 tightly with the sheet metal strip 7 makes the port liner 5 gas-tight in a longitudinal direction from the seating ring area 3 to the exhaust flange area 4 and insulated due to the air-gap between the layers of sheet metal.

FIG. 2 illustrates a straight piece of a port liner 5 according to the present invention having a sheet metal port 6 and a sheet metal strip 7 wound around the sheet metal port. The sheet metal strip 7 is wider than the distance 9 from one winding to the next, resulting in a multiple winding layer. The individual layers of the winding are thermally insulated from one another due to the coating of the sheet metal strip 7. An additional insulation volume 10 is arranged in the space that winds with triangular cross-section helically around the sheet metal port 6 and is formed by two adjacent winding layers of the sheet metal strip 7 and the sheet metal port. This arrangement of the sheet metal port 6 and the wound sheet metal strip 7 provides a good thermal insulation, stable support for the sheet metal port in the cylinder head 1, and the facility for thermal expansion and inexpensive manufacture by wrapping the sheet metal port with a thin sheet metal strip. The sheet metal port 6 is endowed by internal high-pressure metal forming with a shape favorable to the exhaust gas flow. The sheet metal strip 7 is produced from essentially thinner sheet metal and may therefore be wound around the sheet metal port 6 without resulting in large hollow cavities or varying wall thicknesses of the port liner.

What is claimed is:

1. A cylinder head of an internal combustion engine, comprising:

at least one exhaust port including a port liner cast into the cylinder head and having at least two layers, the liner including:

a heat-insulating layer;

a sheet metal port; and a helically wound sheet metal strip surrounding the sheet metal port.

2. The cylinder head according to claim 1, wherein the sheet metal port is cast into the cylinder head in an area of a valve guide.

3. The cylinder head according to claim 1, wherein the wound sheet metal strip is configured to support the sheet metal port so that the sheet metal port is longitudinally displaceable in the cylinder head.

4. The cylinder head according to claim 1, wherein the sheet metal strip includes a coating.

5. The cylinder head according to claim 4, wherein the coating includes graphite.

6. The cylinder head according to claim 1, wherein the sheet metal port is formed by internal high-pressure metal forming.

7. The cylinder head according to claim 1, wherein the sheet metal port includes a greater wall thickness than the sheet metal strip.

8. The cylinder head according to claim 1, wherein the port liner is formed from a tube wrapped prior to an internal high-pressure metal forming.

* * * * *